US007866263B2

(12) United States Patent
Magne et al.

(10) Patent No.: US 7,866,263 B2
(45) Date of Patent: Jan. 11, 2011

(54) GLASS-METAL FEEDTHROUGH, A METHOD OF FABRICATING IT, AND AN ELECTRO-PYROTECHNIC INITIATOR INCLUDING IT

(75) Inventors: Alain Magne, Pantin (FR); Adelino Carrol, Viarmes (FR); Grégory Minuzzo, Villemur sur Tarn (FR)

(73) Assignee: Autoliv Development AB, Vargarda (SE)

( * ) Notice: Subject to any disclaimer, the term of this patent is extended or adjusted under 35 U.S.C. 154(b) by 0 days.

(21) Appl. No.: 12/084,218

(22) PCT Filed: Nov. 9, 2006

(86) PCT No.: PCT/EP2006/068273

§ 371 (c)(1),
(2), (4) Date: May 16, 2008

(87) PCT Pub. No.: WO2007/054530

PCT Pub. Date: May 18, 2007

(65) Prior Publication Data

US 2009/0158953 A1 Jun. 25, 2009

(30) Foreign Application Priority Data

Nov. 9, 2005 (FR) ..... 05 11404

(51) Int. Cl.
*F42B 3/18* (2006.01)

(52) U.S. Cl. ..... 102/202.1; 102/202.12

(58) Field of Classification Search ..... 102/202.7, 102/206, 202.9, 202.12, 202.14
See application file for complete search history.

(56) References Cited

U.S. PATENT DOCUMENTS

| | | | | |
|---|---|---|---|---|
| 3,082,691 | A * | 3/1963 | Evans et al. | 102/202.14 |
| 4,402,269 | A * | 9/1983 | Smith | 102/202.13 |
| 4,453,033 | A * | 6/1984 | Duff et al. | 174/527 |
| 4,614,836 | A * | 9/1986 | Carpenter et al. | 174/51 |
| 4,735,145 | A * | 4/1988 | Johnson et al. | 102/202.5 |
| 5,672,841 | A * | 9/1997 | Monk et al. | 102/202.4 |
| 5,798,476 | A * | 8/1998 | Bailey | 102/202.7 |
| 5,924,727 | A * | 7/1999 | Honda et al. | 280/736 |
| 6,557,474 | B1 * | 5/2003 | Morte et al. | 102/202.1 |
| 7,652,868 | B2 | 1/2010 | Gaudinat et al. | |
| 2004/0075260 | A1 | 4/2004 | Heeke | |

FOREIGN PATENT DOCUMENTS

| | | | |
|---|---|---|---|
| DE | 10 2004 004748 | A1 | 9/2004 |
| EP | 0 779 492 | A | 6/1997 |
| JP | 60 105829 | A | 6/1985 |

* cited by examiner

*Primary Examiner*—Michael Carone
*Assistant Examiner*—Reginald Tillman, Jr.
(74) *Attorney, Agent, or Firm*—Harness, Dickey & Pierce, P.L.C.

(57) ABSTRACT

A glass-metal feed-through transmits an electrical signal from one face to another face that is opposite. The feed-through includes a glass plug, two metal pins passing through the plug, and a metal part surrounding the plug. The feed-through includes an electrically-conductive link between a first of the pins and the part. The link includes a brazing preform secured to the first pin and to the part.

19 Claims, 2 Drawing Sheets

GLASS-METAL FEEDTHROUGH, A METHOD OF FABRICATING IT, AND AN ELECTRO-PYROTECHNIC INITIATOR INCLUDING IT

CROSS-REFERENCE TO RELATED APPLICATIONS

This application is a 371 National Stage of International Application No. PCT/EP2006/068273, filed Nov. 9, 2006 and published in English as WO 2007/054530 A1 on May 18, 2007. This application claims the benefit of French Patent Application 05 11404, filed Nov. 9, 2005. The disclosures of the above applications are incorporated herein by reference.

The invention relates to a glass-metal feedthrough for transmitting an electrical signal from one face to another face opposite therefrom, to an electro-pyrotechnic initiator including the feedthrough, and to a method of fabricating it.

One field of application of the invention relates to electro-pyrotechnic initiators for use in powering gas generators for activating devices for protecting the occupants of motor vehicles, such as, for example: airbags or safety-belt pretensioners.

In an electro-pyrotechnic initiator, the feedthrough conventionally comprises a glass plug surrounded by a metal part, and two pins for bringing in the signal from the outside, which pins are insulated from each other by the plug. The electrical signal is fed to a heater element in contact with a pyrotechnic charge situated in a compartment of the initiator that is closed by the glass plug, thereby causing the heater element to ignite the charge. The feedthrough must both close the compartment containing the pyrotechnic charge hermetically, and withstand operating pressures and environmental stresses (e.g. climatic and/or mechanical). In addition, in order to contribute to withstanding electrostatic discharges, one of the two pins is connected to electrical ground by being connected to the metal part surrounding the plug, with this pin then being referred to as the coaxial pin, and the glass feedthrough then being referred to as an insulated, hermetically-sealed, and coaxial glass feedthrough.

U.S. Pat. No. 6,274,252 describes a glass feedthrough in which one pin passes through the glass plug, while the other pin is bonded directly to the metal part. The drawback of that feedthrough is that the two pins are not identical. In addition, fabrication requires a plurality of steps, namely initially mounting the through pin in the plug and the metal part, and subsequently welding the coaxial pin under the metal part. That feedthrough requires the pins to be made asymmetrically, thereby complicating the definition of the coaxial pin.

U.S. Pat. No. 6,755,670 describes a feedthrough in which a solder coated cover piece is sealed within a glass stopper together with the two metal pins. The solder coated cover piece provides a conducting connection between the pin it surrounds and a metallic sleeve surrounding the glass stopper, however it presents the drawback of being complicated to assemble with the glass stopper. In addition, the feedthrough makes it necessary to use a glass stopper of a special shape to enable the cover piece to be added thereto.

The invention seeks to provide a glass-metal feedthrough, an electro-pyrotechnic initiator, and a method of fabricating the feedthrough, that mitigate the drawbacks of the prior art by being simple and inexpensive to implement.

To this end, in a first aspect, the present invention provides a glass-metal feed-through for transmitting an electrical signal from one face to another face that is opposite, the feedthrough comprising:

a glass plug;

two electrically-conductive metal pins for conveying the electrical signal, the pins passing through the glass plug, being secured thereto, and projecting from said two opposite faces of the plug; and an electrically-conductive metal part surrounding the glass plug between the two opposite faces of the plug;

the feed-through being characterized in that it further comprises:

electrically-conductive link means between a first of the two metal pins and the metal part, disposed on the bottom, first face of the plug; and the electrically-conductive link means being constituted by a brazing preform secured to the first pin and to the metal part and suitable for conducting electricity between the first pin and the metal part.

The invention presents the advantage of better reproducibility, in particular because of the coaxial first pin being brazed directly to the metal part. The invention avoids the need for an intermediate cover piece provided with a coating and that is accurately complementary in shape to the glass plug as is required in above-mentioned document U.S. Pat. No. 6,755,670, thereby simplifying the provision of the connection between the coaxial first pin and the metal part.

In a second aspect, the invention provides an electro-pyrotechnic initiator, comprising:

a cap containing a pyrotechnic charge;

an insulating printed circuit plate having a first face on which there is a resistive heater element for heating the pyrotechnic charge, the heater element being covered by the charge, and a second face opposite from the first face;

the initiator being characterized in that it includes:

a glass-metal feed-through as described above, that supports the second face of the insulating printed circuit plate on the second face of the plug, opposite from the first face of the plug, and that closes of the cap;

the two metal pins being electrically connected to the resistive heater element.

In a third aspect, the invention provides a method of fabricating a glass-metal feed-through as described above, characterized in that:

the brazing preform has a hole for passing the first pin, and the brazing preform is placed around the first pin, the glass plug is sealed in the metal part and the brazing preform is brazed to the metal part and to the first pin in a single pass through an oven.

The invention can be better understood on reading the following description given purely by way of non-limiting example and with reference to the accompanying drawings, in which.

Figure 1:
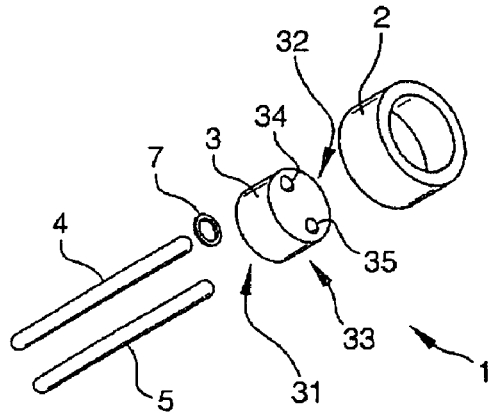
FIG. 1 is an exploded perspective view of the various portions of a feedthrough of the invention.
Figure 2:
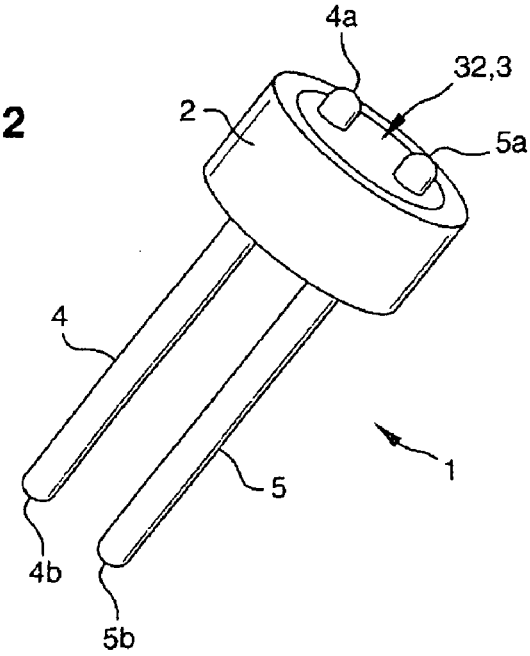
FIG. 2 is a perspective view seen from above showing the FIG. 1 feedthrough in the assembled state.
Figure 3:
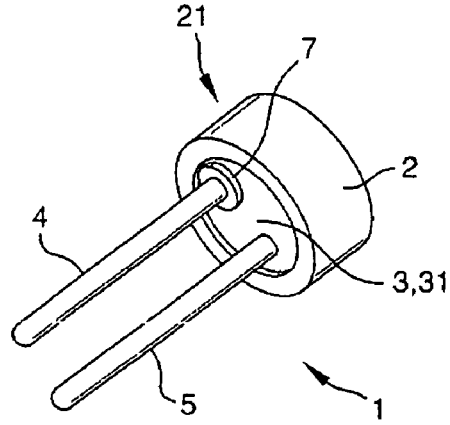
FIG. 3 is a perspective view seen from below of the FIG. 1 feedthrough in the assembled state.

In FIGS. 1 to 3, the insulated, hermetically-sealed, and coaxial glass feedthrough 1 comprises an outer metal part 2 surrounding a glass plug 3 in vacuum-tight manner. By way of example, the metal part 2 is in the form of a segment of circular tube, commonly referred to as a metal eyelet. The glass plug 3 has a bottom first face 31 and a top second face 32 remote from the bottom first face 31. The metal part 2 surrounds the side surface 33 of the plug 3, i.e. the face interconnecting the first face 31 and the second face 32. By way of example, both the metal part 2 and the glass plug present the same height h between the faces 31 and 32.

The plug 3 has two through holes 34 and 35, each going from the first face 31 to the second face 32. Two pins, i.e. a first 4 and a second pin 5, pass respectively along the holes 34 and 35 in hermetically-sealed manner, each having a bottom length projecting from the bottom face 31 that is longer than its length projecting from the top face 32. In the embodiment shown on the drawings, the two pins 4 and 5 are entirely circularly cylindrical and strictly identical.

Figure 4:
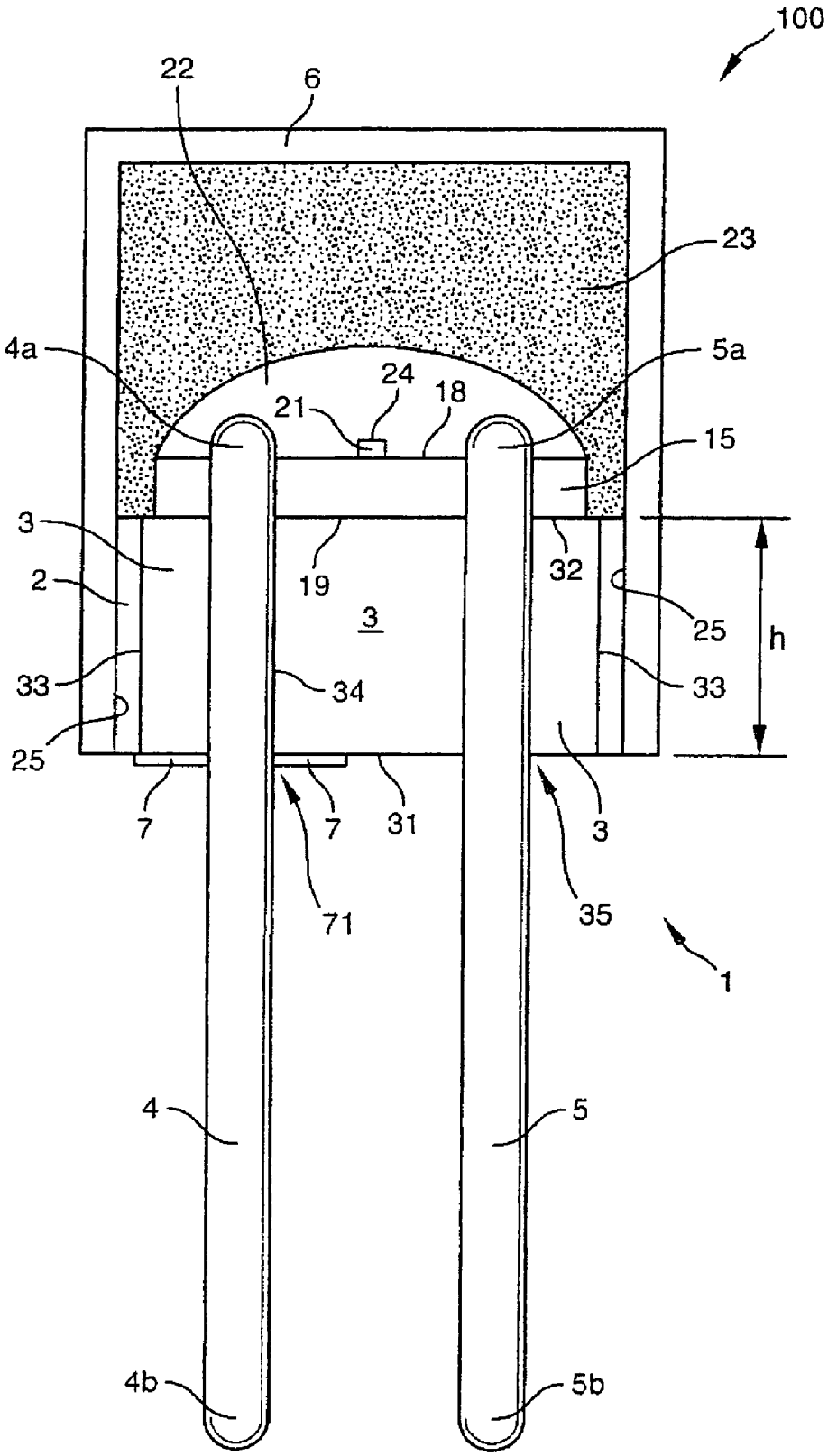
FIG. 4 is a vertical section view of an electro-pyrotechnic initiator having the feedthrough of FIGS. 1 to 3 mounted therein.

As shown in FIG. 4, when the assembled feedthrough 1 is mounted in an electro-pyrotechnic initiator 100, the top second face 32 is the face that faces towards the pyrotechnic charge 22, 23 for igniting the initiator, while the bottom first face 31 is the face that should face to the outside. The pyrotechnic charge 22, 23 is enclosed between the top, second face 32 and a metal cap 6 clamped around the outside face 25 of the metal part 2. The feedthrough 1 thus closes the open end of the cap 6 and is secured thereto. The bottom first face 31 of the feedthrough 1 and the bottom portion of the cap 6 may optionally be enclosed in overmolding (e.g. of plastics material). The overmolding enables the igniter to be fitted to the generator.

On its top second face 32, the plug 3 is provided with an electrically insulating plate 15 that has the two top ends 4*a* and 5*a* of the pins 4 and 5 passing therethrough. The top, first face 18 of the plate 15 carries a printed circuit including a resistive heater element 21 which is connected by printed conductor tracks to the two ends 4*a* and 5*a* of the two pins 4 and 5 that project beyond the face 18. The top surface 24 of the resistive heater element 21 is in contact with and covered by the priming pyrotechnic charge 22 which is itself covered by the ignition pyrotechnic charge 23. Opposite from the top, first face 18, the bottom, second face 19 of the insulating plate 15 lies against the top second face 32 of the feedthrough 1.

The two bottom ends 4*b* and 5*b* of the pins 4 and 5 that are remote from their first ends 4*a* and 5*a* facing towards the pyrotechnic charge 22, 23 are for electrical connection with the outside, enabling an electrical signal to be sent to heat the element 21, thereby igniting the pyrotechnic charges 22 and 23.

In accordance with the invention, an electrically-conductive brazing preform 7 connecting the metal part 2 electrically to the first pin 4 is provided on the bottom first face 31 of the plug 3, while the second pin 5 remains electrically insulated from the first pin 4.

For example, the brazing preform 7 is in the form of a washer surrounding the first pin 4 on the first face 31 of the glass plug 3.

The dimensions of the brazing preform 7 are selected as a function of the distance between the first coaxial pin 4 and the inside face of the metal part 2, and also as a function of the diameter of the pins 4 and 5. The outside diameter of the brazing preform 7 provides an initial contact between said brazing preform 7 and the metal part 2. The inside diameter of the brazing preform 7 enables it to be threaded via its through hole 71 onto the first pin 4 and slid therealong so as to make them easy to assemble together.

By way of example, the thickness of the brazing preform 7 measured in the vertical direction perpendicular to the bottom face 31 is greater than or equal to 0.3 mm, and less than or equal to 0.5 mm, in order to obtain a brazed connection of good quality.

The first face 31 of the glass plug 2 having the brazing preform 7 placed thereon is constituted by a plane surface. This makes it possible to avoid any need to adopt a special shape for the glass plug 3 in order to accommodate the presence of the electrical connection between the pin 4 and the metal part 2.

The brazing preform 7 forms a spot face around the first pin 4 on the first face 31.

The brazing preform 7 is made of a metal or metal alloy. The material of the brazing preform 7 is selected as a function of its liquidus temperature, i.e. the temperature at which solidification of the material begins, or as a function of its solidus temperature, i.e. the temperature at which the material begins to melt. The brazing preform 7 is made of a brazing metal or a brazing metal alloy, presenting a liquidus temperature and a solidus temperature lying between the maximum temperature for sealing the glass plug 3 in the metal part 2 and respectively the liquidus temperature and the solidus temperature of the glass of the plug 3. The material of the brazing preform 7 is selected as a function of its ability to wet the metal(s) of the pin 4 and of the part 2. By way of example, the brazing preform is made of a brazing metal alloy selected from copper-silver alloys and from copper-silver-nickel alloys.

The method of fabricating the above-described glass-metal feedthrough 1 is thus made particularly simple, fast, and inexpensive. The components 2, 3, 4, 5, and 7 of the feedthrough 1 are initially assembled together in common tooling made of graphite. The graphite tooling is adapted to receive the brazing preform 7 coaxially around the first pin 4. The depth of the spot face is designed to avoid any unbalance of the glass plug 3 during the assembly process.

The method of sealing the glass plug 3 relative to the metal part 2 is of the compression type. The two pins 4 and 5 are sealed in the glass plug 3 and the brazing preform 7 is brazed to the coaxial pin 4 and to the metal part 2 in a single pass through an oven, using a temperature profile adapted to the type of sealing selected.

The disposition of the brazing preform 7 on the inside face 31 opposite from the top face 32 that is to face towards the pyrotechnic charge 22, 23 of the initiator 100 in association with the use of identical cylindrical pins avoids any risk of components becoming mixed up during fabrication of the feedthrough 1.

The invention claimed is:

1. A glass-metal feed-through for transmitting an electrical signal from one face to another face that is opposite, the feed-through comprising:

a glass plug;

two electrically-conductive metal pins for conveying the electrical signal, the pins passing through the glass plug, being secured thereto, and projecting from said two opposite faces of the plug;

an electrically-conductive metal part surrounding the glass plug between the two opposite faces of the plug, the two opposite faces each defining a continuous single planar surface within a perimeter of each face, the glass plug being directly sealed to the metal part; and an electrically-conductive link directly connecting a first of the two metal pins and the metal part, disposed directly on a first face of the two opposite faces of the plug, the first face being a bottom face, the electrically-conductive link being a brazing preform disposed directly on the bottom face and secured to the first pin and to the metal part, the brazing preform suitable for unconditionally conducting electricity directly between the first pin and the metal part and surrounding only the first pin of the two metal pins.

2. The glass-metal feed-through according to claim 1, wherein the brazing preform is in the form of a washer surrounding the first pin and disposed directly on the first face of the glass plug, the washer directly connecting the first pin to the metal part.

3. The glass-metal feed-through according to claim 1, wherein the brazing preform forms a facing around the first pin directly on the first face.

4. The glass-metal feed-through according to claim 1, wherein the brazing preform has a thickness between approximately 0.3 mm and approximately 0.5 mm.

5. The glass-metal feed-through according to claim 1, wherein the brazing preform is made of a brazing metal or of a brazing metal alloy having a liquidus temperature lying between a liquidus temperature of the glass plug and a maximum sealing temperature of the glass plug in the metal part.

6. The glass-metal feed-through according to claim 1, wherein the brazing preform is made of a brazing metal alloy selected from a group including copper-silver alloys, copper-silver-nickel alloys and combinations thereof.

7. The glass-metal feed-through according to claim 1, wherein the pins are substantially identical.

8. The glass-metal feed-through according to claim 1, wherein the pins have a constant cross section along their lengths.

9. The glass-metal feed-through according to claim 1, wherein the metal part has substantially the same height as the glass plug between the two opposite faces.

10. A method of fabricating a glass-metal feed-through according to claim 1, comprising:

placing the brazing preform around the first pin, the first pin passing through a hole in the brazing preform;

sealing the glass plug in the metal part; and brazing the brazing preform to the metal part and to the first pin in a single pass through an oven.

11. An electro-pyrotechnic initiator, comprising:

a cap containing a pyrotechnic charge;

an insulating printed circuit plate having a first face on which there is a resistive heater element for heating the pyrotechnic charge, the heater element being covered by the charge, and a second face opposite from the first face; and a glass-metal feed through, including:

a glass plug having first and second opposite faces, the first and second opposite faces each defining a continuous single planar surface within a perimeter of each face;

two electrically-conductive metal pins for conveying an electrical signal, the pins passing through the glass plug, being secured thereto, and projecting from said two opposite faces of the plug;

an electrically-conductive metal part surrounding the glass plug between the two opposite faces of the plug, the metal part having substantially the same height as the glass plug between the two opposite faces, wherein the cap surrounds the metal part and includes a height greater than the height of the metal part; and an electrically-conductive link directly connecting a first of the two metal pins and the metal part, disposed directly on a first face of the two opposite faces of the plug, the first face being a bottom face, the electrically-conductive link being a brazing preform disposed directly on the bottom face and secured to the first pin and to the metal part, the brazing preform suitable for unconditionally conducting electricity directly between the first pin and the metal part and surrounding only the first pin of the two metal pins;

wherein the glass-metal feed-through supporting supports the second face of the insulating printed circuit plate on the second face of the plug, opposite from the first face of the plug, and closes off the cap;

wherein the two metal pins are electrically connected to the resistive heater element.

12. The electro-pyrotechnic initiator of claim 11, wherein the brazing perform is in the form of a washer surrounding the first pin and disposed directly on the first face of the glass plug, the washer directly connecting the first pin to the metal part.

13. The electro-pyrotechnic initiator of claim 11, wherein the brazing perform forms a facing around the first pin directly on the first face.

14. The electro-pyrotechnic initiator of claim 11, wherein the brazing perform has a thickness between approximately 0.3 mm and approximately 0.5 mm.

15. The electro-pyrotechnic initiator of claim 11, wherein the brazing perform is made of a brazing metal or of a brazing metal alloy having a liquidus temperature lying between a liquidus temperature of the glass plug and a maximum sealing temperature of the glass plug in the metal part.

16. The electro-pyrotechnic initiator of claim 11, wherein the brazing preform is made of a brazing metal alloy selected from a group including copper-silver alloys, copper-silver-nickel alloys and combinations thereof.

17. The electro-pyrotechnic initiator of claim 11, wherein the pins are substantially identical.

18. The electro-pyrotechnic initiator of claim 11, wherein the pins have a constant cross section along their lengths.

19. The glass-metal feed-through according to claim 11, wherein the brazing preform is disposed on the bottom face so as to be raised above the single planar surface.

* * * * *